United States Patent [19]

Kubo

[11] Patent Number: 4,988,599

[45] Date of Patent: Jan. 29, 1991

[54] ELECTROPHOTOGRAPHIC COLOR TONER HAVING SELECTED INDEX OF REFRACTION RANGE

[75] Inventor: Masahiko Kubo, Nara, Japan

[73] Assignee: MITA Industrial Co., Ltd., Osaka, Japan

[21] Appl. No.: 293,584

[22] Filed: Jan. 4, 1989

Related U.S. Application Data

[63] Continuation-in-part of Ser. No. 150,457, Jan. 28, 1988, abandoned, which is a continuation of Ser. No. 909,998, Sep. 22, 1986, abandoned.

[30] Foreign Application Priority Data

Sep. 30, 1985 [JP] Japan ..... 60-218518

[51] Int. Cl.[5] ..... G03G 9/08; G03G 13/01

[52] U.S. Cl. ..... 430/109; 430/45; 430/13; 430/950; 430/126; 353/63; 353/64; 353/65

[58] Field of Search ..... 353/63, 64, 65, DIG. 3; 430/45, 13, 950, 109, 126

[56] References Cited

U.S. PATENT DOCUMENTS 4,206,064 6/1980 Kiuchi et al. .

4,259,422 3/1981 Davidson et al. .

OTHER PUBLICATIONS

Kingslake, Applied Optics and Optical Engineering, vol. 1, pp. 303–311 (1965).

*Primary Examiner*—David Welsh

*Attorney, Agent, or Firm*—Spencer & Frank

[57] ABSTRACT

A color toner forming a developed image to be transferred to a transparent sheet by a known electrophotographic method, the refractive index of said color toner being smaller than that of said transparent sheet, but greater than that of the air.

7 Claims, No Drawings

ELECTROPHOTOGRAPHIC COLOR TONER HAVING SELECTED INDEX OF REFRACTION RANGE

CROSS-REFERENCE TO RELATED APPLICATIONS

This application is a continuation-in-part of my application No. 07/150,457, filed Jan. 28th, 1988, now abandoned, which is a continuation of my application No. 06/909,998 filed Sept. 22nd, 1986, and now abandoned, both of which are incorporated herein by reference.

FIELD OF THE INVENTION

This invention relates to a color toner that is used in the development of color electrophotographs. In particular, it relates to a color toner that forms developed images to be transferred to a transparent sheet corresponding to manuscript images by a known electrophotographic method.

TECHNOLOGY REVIEW

In conferences and in presentations of information, overhead projectors, which project an enlargement of a page of information in the form of text and/or illustrations, onto a screen, are often used. Such overhead projectors project an image of the manuscript by passage of light through a transparent sheet on which a developed image corresponding to the manuscript image has been formed.

The use of colors other than black for specific letters or figures in the image for the sake of emphasis or identification has been tried for the use of overhead projectors. For this purpose, it is necessary to use a color toner on the transparent sheet to form the developed image. However, even though the developed image made of a color toner rather than a black toner is formed and fixed on a transparent sheet by a known electrophotographic method, the surface of the color toner image becomes uneven. For this reason, when projection by an overhead projector on such a sheet is done, not only is light absorbed by the color toner, but also light is reflected from the color toner and cannot pass through the color toner. Therefore, the areas of the color toner look black upon projection onto the screen, and projection is not clear. To eliminate these problems, a special process, often an additional step, is necessary at the time of fixation of the color toner to the transparent sheet so that the surface of the color toner image will remain even. A more simple process to project a color image onto a screen would be desirable.

SUMMARY OF THE INVENTION

The color toner of this invention, which overcomes the above-discussed and numerous other disadvantages and deficiencies of the prior art, forms a developed image to be transferred to a transparent sheet by a known electrophotographic method. An important feature of the invention is that the refractive index of said color toner is smaller than the refractive index of said transparent sheet, but greater than the refractive index of the air.

The refractive index of the color toner is, in a preferred embodiment, close to that of the air.

The transparent sheet is, in a preferred embodiment, used in an overhead projector.

Thus, the invention described herein makes possible the objects of (1) providing a color toner by which a developed image can be formed corresponding to manuscript images on a transparent sheet by a known electrophotographic method; (2) providing a color toner that achieves accurate reproduction of the color of the color toner even though the surface of the color toner is uneven when the developed image made of said color toner formed corresponding to manuscript images on a transparent sheet by a known electrophotographic method is projected onto a screen by an overhead projector; and (3) providing a color toner that does not require a step in which the surface of the color toner transferred to a transparent sheet for an overhead projector is made flat to attain accurate reproduction of the color of the color toner when the developed image of the color toner is projected onto a screen by the overhead projector.

DESCRIPTION OF THE PREFERRED EMBODIMENTS

In order that those skilled in the art may better understand how the present invention may be practiced, the following Examples are given by way of illustration and not by way of limitation. All parts and percentages are by weight unless otherwise noted.

EXAMPLE 1

The color toner prepared in this example is the color toner for the formation of a developed image of the transparent sheet. Characteristic of the present invention, the refractive index of the color toner is smaller than that of the transparent sheet, but is greater than that of the air.

As the transparent sheet, polyethylene terephthalate (PETP) with the refractive index of 1.66 was used, and the color toner was made as follows;

Polyacryl resin (as binding resin; refractive index of 1.47) . . . 100 parts by weight Aizen Spilon Blue-GNH (functioning as a coloring agent manufactured by Hodogaya Chemical Co., Japan) . . . 4 parts by weight BONTRON E-84 (a mixture of salicylic acids manufactured by Orient Chemical Co., Japan functioning as an electric charge control agent) . . . 3 parts by weight The refractive index of the color toner made from the above-mentioned formulation is 1.47, which depends upon the refractive index of the binding resin, polyacryl resin. Polyacryl resin refers to a polyacrylate resin and/or a polymethacrylate resin. Examples of polyacrylate resins include poly(methyl acrylate), poly(ethyl acrylate), and poly(butyl acrylate). An example of a polymethacrylate resin is poly(methyl methacrylate).

With an electrophotographic copy machine, a manuscript image was developed with this color toner to form a developed color toner image on the PETP sheet, and the developed color toner image was fixed to the PETP sheet. The color toner forming the developed image on the PETP sheet was in granule form. Since the refractive index of the color toner, 1.47, was smaller than that of the PETP sheet, 1.66, even if the boundary surface between the PETP sheet and the color toner was not flat, the critical angle at the boundary surface was about 66.8°Thus, almost all of the light striking the PETP sheet at almost right angles entered the color toner through the PETP sheet. The refractive index of the color toner, 1.47, was greater than that of the air, 1.00, so that even when the boundary surface between the color toner and the air was not flat, the critical angle at the boundary surface was about 42.8° and light striking the boundary surface within this critical angle went into the air through the color toner, without being reflected at the boundary surface. Thus, when the refractive index of the color toner meets the above-mentioned conditions which characterize the present invention, most of the light striking the PETP sheet at almost right angles passes through the color toner, so that when, for example, a developed image is projected by an overhead projector onto a screen, the color of the color toner forming the developed image is accurately reproduced.

The refractive index of the color toner is preferably set to be close to that of the air, thereby allowing an enlargement of the critical angle at the boundary surface between the color toner (the surface of which may be rough) and the air, so that the amount of light going into the air through the color toner increases, which attains accurate reproduction of the color of the color toner via an overhead projector.

The refractive index of the color toner depends upon that of the binding resin. The above-mentioned example discloses polyacryl resin as the binding resin used for the color toner, but it is not limited thereto. Any resin having a refractive index smaller than that of the transparent sheet can be used as the binding resin. For example, it is possible to use silicone resin that has a refractive index of 1.41. The refractive index of binding resins can be changed. The refractive index of a binding resin increases when a halogen other than fluorine and/or an unsaturated group is introduced into each of the repeating units of the binding resin of high molecular weight. When fluorine is introduced thereinto the refractive index of the binding resin decreases.

EXAMPLE 2

A series of tests of binding resins was conducted, the results of which are summarized in the Table below.

TABLE

| Ex. No. | Resin | Refractive Index | Softening Point (°C.) | Transparency | Distinctness of Image |
|---|---|---|---|---|---|
| 1 | Acrylic | 1.47 | 130 | 0 | 0 |
| 2 | MMA + EA | 1.49 | 122 | 0 | 0 |
| 3 | MMA + EA | 1.49 | 130 | 0 | 0 |
| 4 | MMA + EA | 1.49 | 138 | 0 | 0 |
| 5 | MMA + EA | 1.49 | 145 | X | 0 |
| 6 | MMA + EA | 1.49 | 110 | 0 | X |
| 7 | Polyester | 1.57 | 101 | X | 0 |
| 8 | Styrene-Acrylic | 1.56 | 109 | X | 0 |

0 = satisfactory result
X = unsatisfactory result

The distinctiveness of the image was determined by observing whether the image was clear and sharp. Surprisingly, it was found that the binding resin must have a softening point between about 120° C. and 140° C. to produce a color toner with satisfactory transparency and distinctiveness of image. The refractive index of the binding resin, and therefore of the color toner, should be greater than 1.0 and not more than about 1.50.

According to the above-mentioned examples, even when the surface of the color toner of the developed image transferred onto a transparent sheet is uneven, the amount of light passing through the color toner is increased. Therefore, when the developed color toner image is projected onto a screen by an overhead projector, accurate reproduction of the color of the color toner is achieved. When manuscript images are made by a known electrophotographic method on transparent sheets for use in overhead projectors, it is not necessary to have a step in which the surface of the color toner transferred to the transparent sheet is made flat, and electrophotographic copy machines can be used.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A color toner for forming a developed image on a polyethylene terephthalate (PETP) transparent sheet, comprising:

a coloring agent means, and a polyacrylate or polymethacrylate binding resin means, said binding resin means having a softening point between about 120° C. and 140° C., and said color toner having a refractive index smaller than about 1.50 and greater than about 1.00.

2. A color toner according to claim 1, wherein the refractive index of said color toner is about one.

3. A color toner according to claim 1, wherein said transparent sheet is used in a transmission-type overhead projector.

4. A method for fixing a color image to a polyethylene terephthalate (PETP) transparent sheet for use in a transmission-type overhead projector, comprising steps for:

forming an electrostatic latent image on a surface of a substrate, developing said latent image with a color toner containing a coloring agent means and a transparent polyacrylate or polymethacrylate binding resin means, said binding resin means having a softening point between about 120° C. and 140° C., the refractive index of said color toner being smaller than about 1.50 and greater than about 1.00, transferring said developed color toner image to a PETP transparent sheet, and fixing said developed color toner image to said PETP transparent sheet.

5. The method for fixing a color image to a PETP transparent sheet according to claim 4, wherein the refractive index of said color toner is about one.

6. The method for fixing a color image to a PETP transparent sheet according to claim 4, wherein at a boundary surface between said color image and said transparent sheet the critical angle is at least about 66.8°.

7. A color toner according to claim 1, wherein at a boundary surface between said color toner and air the critical angle is at least about 42.8°.

* * * * *